US008550672B2

(12) United States Patent
Sullivan et al.

(10) Patent No.: US 8,550,672 B2
(45) Date of Patent: Oct. 8, 2013

(54) ELECTRONIC BALLAST ASSEMBLY

(75) Inventors: Rodney L. Sullivan, Jackson, MI (US); Nicholas D. Page, Reading, MI (US)

(73) Assignee: The Shane Group, Hillsdale, MI (US)

( * ) Notice: Subject to any disclaimer, the term of this patent is extended or adjusted under 35 U.S.C. 154(b) by 241 days.

(21) Appl. No.: 13/190,038

(22) Filed: Jul. 25, 2011

(65) Prior Publication Data

US 2013/0027933 A1 Jan. 31, 2013

(51) Int. Cl.
*F21S 13/00* (2006.01)

(52) U.S. Cl.
USPC ..... 362/431

(58) Field of Classification Search
USPC ..... 362/431
See application file for complete search history.

(56) References Cited

U.S. PATENT DOCUMENTS

| | | | | |
|---|---|---|---|---|
| 4,190,881 | A * | 2/1980 | Drost et al. | 362/249.01 |
| 5,426,577 | A * | 6/1995 | Gordin et al. | 362/431 |
| 5,908,236 | A * | 6/1999 | Lueken et al. | 362/364 |
| 6,393,608 | B1 | 5/2002 | Pulford et al. | |
| 6,398,392 | B2 * | 6/2002 | Gordin et al. | 362/431 |
| 6,632,100 | B1 | 10/2003 | Richardson | |
| 6,679,619 | B2 | 1/2004 | Saieva | |
| 6,773,130 | B1 | 8/2004 | Richardson | |
| 7,314,290 | B2 | 1/2008 | Saieva | |
| 2004/0129894 | A1 | 7/2004 | Coulombe et al. | |
| 2007/0019403 | A1 | 1/2007 | Boghossian | |
| 2010/0117541 | A1 | 5/2010 | Gray et al. | |

* cited by examiner

*Primary Examiner* — Julie Shallenberger
(74) *Attorney, Agent, or Firm* — Young Basile Hanlon & MacFarlane PC

(57) ABSTRACT

An electronic ballast mounting arrangement for HID luminaires on a vertical pole for sports lighting is disclosed. The mounting arrangement comprises an elongate channel to which a weather tight enclosure is fixedly secured. Electronic ballast units are provided in pairs immediately above and/or below the enclosure. Male/female connectors are arranged between end plates of the electronic ballast units and exterior panels of the enclosure so that electrical connections between the ballast units and components on the interior of the enclosure can be made without exposed cables simply by sliding partially pre-mounted ballast units a limited distance toward the adjacent enclosure panel to mate the complemental parts of the connectors, after which the fasteners holding the ballast units to the support are tightened down. A cable using wires with a high-strand count extends through a nipple screwed into a hollow pole from the interior of the weather proof enclosure into the center of the pole and runs upwardly through the pole to the luminaires mounted on one or more cross arms on the top of the pole. A Kelem grip hanger is used to support the cable and relieve tension on the electrical connections between the cable and the luminaires.

11 Claims, 8 Drawing Sheets

ELECTRONIC BALLAST ASSEMBLY

FIELD OF THE INVENTION

The invention relates to lighting systems of the type comprising high-intensity discharge (HID) lighting fixtures and electronic ballast units for said fixtures.

BACKGROUND OF THE INVENTION

HID lighting fixture are typically used in multiples for illuminating football fields, baseball fields, soccer fields, racetracks, tennis courts and other sport activity areas. A typical installation includes a plurality of poles with one or more cross arms carrying HID lighting fixtures near the top of the pole. In addition, there are electronic components including ballast units located farther down the pole albeit typically high enough from the ground to discourage vandalism or tampering. The ballasts and the fixtures are typically electrically connected using cables having PVC outer sheathing materials which, although relatively weather resistant, are subject to deterioration due to ultraviolet rays and other factors.

SUMMARY OF THE INVENTION

According to one aspect, the present invention provides an improved electronic component mounting system for HID fixtures (sometimes called "luminaires") which improvement virtually eliminates the presence of PVC sheathed cables exposed to the elements. In general, an implementation of the invention comprises a support adapted to be mounted to a pole or other structure, a weather tight enclosure fixedly mounted to the support and containing circuit elements such as fuse blocks and connector blocks, and one or more electronic ballast units which are mounted to the support immediately adjacent the enclosure and in such a way as to accommodate limited sliding movement of each ballast unit relative to the weather tight enclosure to make electrical connections between the ballasts and the components in the enclosure. This movement can be activated, for example, by loosening the conventional fasteners which are used to secure the ballast units to the support and providing elongate holes in mounting brackets so the units can slide a limited distance toward and away from the enclosure when the fasteners are loose. One or more electrical connectors of the type having first and second plug or slide-together complemental parts are used to make electrical connections between the electronic ballast units and the components on the interior of the enclosure.

In an illustrative embodiment, one of the two complemental parts of each connector is mounted to an end of a ballast unit and the other of the two components is mounted to an exterior panel of the enclosure so that, when a ballast unit is correctly and slidably mounted on the support, the two connector parts are aligned. When the ballast unit is caused to slide toward the enclosure unit, this movement causes the aligned connector parts to be joined together whereafter the ballast unit fasteners are tightened down to complete the assembly. In a typical installation, there are two complemental connectors, one for input to the ballast and one for output from the ballast.

As will be apparent from a reading from the following specification, there is a ballast unit for each of the HID lighting fixtures on a given pole or other support. The embodiments hereinafter described include an assembly having four electronic ballast units, two of said electronic ballast units being mounted in side-by-side relationship immediately above the weather tight enclosure and two additional electronic ballast units mounted in side-by-side relationship immediately below the weather tight enclosure. All of the ballast units and the weather tight enclosure are mounted on a support structure such as an elongate steel channel which is readily secured to a pole or other structure.

In the ultimately preferred embodiment, the ballast assembly is mounted to a hollow pole well below the fixture-carrying cross arm or arms at the top of the pole. A multi-wire cable connecting the ballast assembly to the lighting fixtures runs through the interior of the pole in such a way as to protect it from the elements as well as vandalism and/or tampering. A nipple is mounted on the back wall of the enclosure so as to extend through the support channel and into a threaded aperture in the pole and the cable exits the enclosure through the nipple and enters the pole interior where it runs to the fixtures.

In the preferred form, the cable which is used to join the electronic ballast units to the remote HID lighting fixtures comprises multiple polyethylene-sheathed, color coded 14 gauge wires each containing 266 strands of tinned copper, the combination of said color-coded 14 gauge wires being wrapped in a PVC sheath which in turn is provided with a hanger which takes the weight of the cable and substantially reduces or eliminates tension on the electrical connections near the top of the pole from the cable to the individual HID lighting fixtures.

The invention is disclosed in two forms; a four-ballast unit and a two-ballast unit. The principles of mounting and using the assembly are essentially the same in both embodiments.

Other advantages, features and characteristics of the present invention, as well as methods of operation and functions of the related elements of the structure, and the combination of parts and economies of manufacture, will become more apparent upon consideration of the following detailed description and the appended claims with reference to the accompanying photographs, the latter being briefly described hereinafter.

BRIEF SUMMARY OF THE DRAWINGS

The description herein makes reference to the accompanying drawings wherein like reference numerals refer to like pails throughout the several views and wherein.

DETAILED DESCRIPTION OF THE ILLUSTRATIVE EMBODIMENTS

Figure 1:
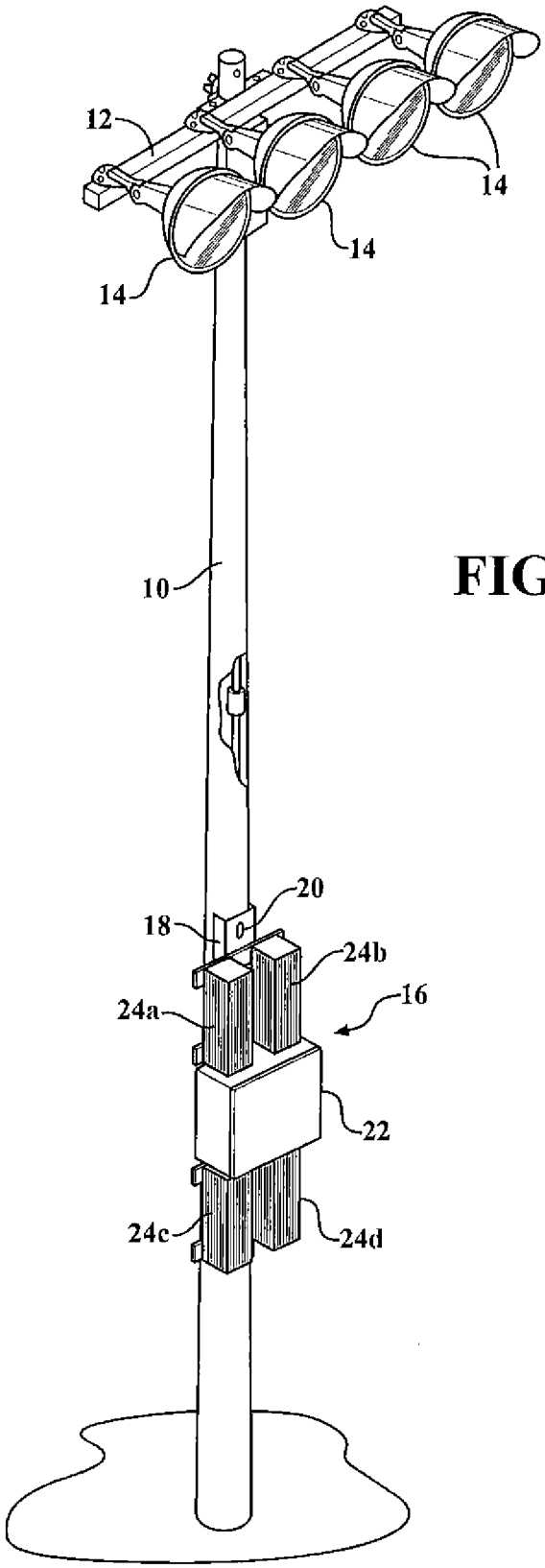
FIG. 1 is a perspective view of a pole carrying four HID fixtures and an assembly of four ballast units and a weather-tight enclosure mounted to the pole.
Figure 3:
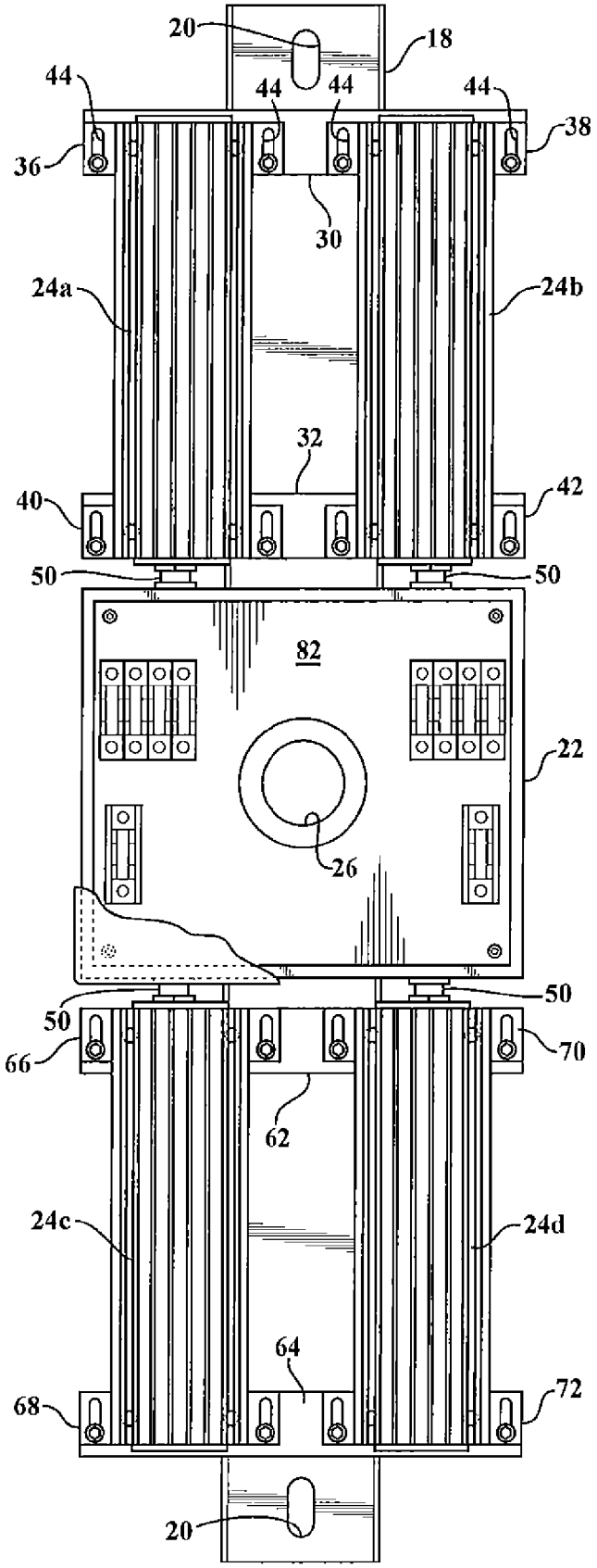
FIG. 3 is a front plan view of the four-ballast assembly of FIG. 1.
Figure 4:
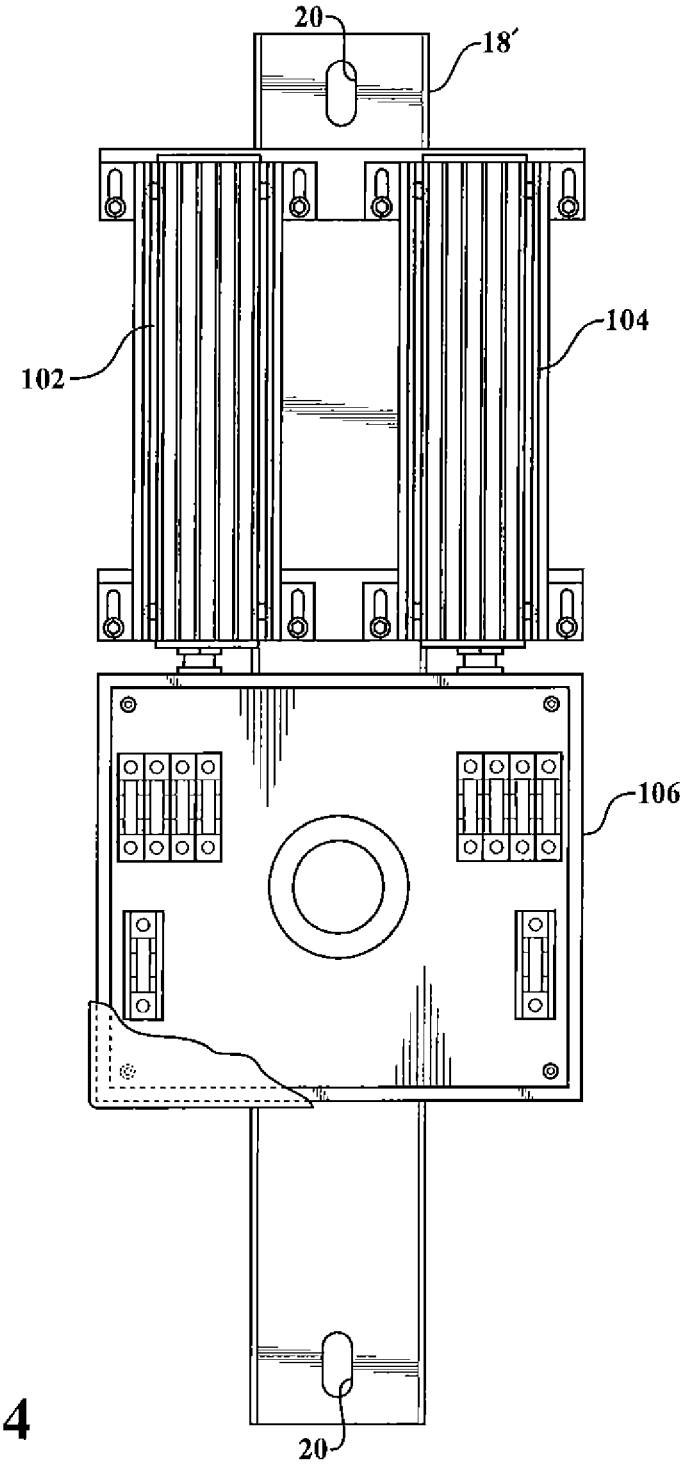
FIG. 4 is a front plan view of a two-ballast assembly.

FIG. 1 illustrates an industrial application of the present invention in the form of an athletic field lighting unit comprising a hollow steel pole 10 approximately 30 to 60 or more feet in length and suitably anchored in the ground. The pole is equipped with a single cross arm 12 fastened to the pole near the top and extending at right angles to the longitudinal axis of the pole 10 and carrying four conventional HID luminaires 14, typical luminaires including a 1500 watt HID lamps, visors and other accessories as will be apparent to those skilled in the HID lighting arts. Mounted on the pole 10 well below the cross arm 12 is an electronic ballast assembly 16 comprising a support member in the form of an elongate steel or aluminum channel 18 approximately 4½ feet long, 6 inches wide and approximately 2 inches deep. It is mounted to the pole 10 by way of studs (not shown) which extends through elongate holes 20 in the channel 18 near the top and bottom ends. Mounted to the channel 18 approximately centrally is a weather tight enclosure 22 typically of a type which is made of steel and has a gasketed hinged metal door to provide access to the interior of the enclosure. Housed within the enclosure 22 are connector blocks, fuse blocks and other necessary elements to comprise an operative assembly as generally shown in FIGS. 3 and 4. Mounted immediately above the enclosure 22 and in close proximity thereto there are electronic ballast units 24*a*, 24*b* which serve two of the four luminaires 14 on the cross arm 12 near the top of the pole 10. Mounted immediately below the enclosure 22 and in close proximity thereto are two additional electronic ballast units 24*c*, 24*d* which serve as the other two luminaires 14 on the cross arm 12. Each pair of electronic ballast units is in side-by-side relationship. Suitable ballast units are available from Nedap of Groenlo, Holland. They are rated 1500 watts and from 10 to approximately 7.6 amps. Each electronic ballast unit is about 18 inches long by 4 inches by 6 inches, The units in a side-by-side pair are mounted about 4 inches apart. The unit 16 is preferably mounted to the pole approximately 10 feet off of the ground so as to discourage tampering and/or vandalism.

Referring now to the remaining figures, the details of two illustrative embodiments of the invention will be described. The four-ballast assembly will be described first.

The support for the assembly 16, as previously described, is in the form of an elongate, three-sided steel or aluminum channel member 18 which in the case of the four-ballast unit assembly is about 4½ feet long. Oblong holes 20 are provided in the channel 18 near the top and bottom to receive studs welded into the pole 10 at pre-selected locations. The front surface of the channel member 18 is flat and, in the typical installation, vertical or as close to vertical as possible in accordance with the limitations on mounting the pole 10 in a suitable foundation. It is to be understood that a pole mount is just one of many different mounting arrangements which can be used; for example, it may be possible to mount luminaires to the side of a grandstand structure, a wall or some other suitable structure.

Figure 5:
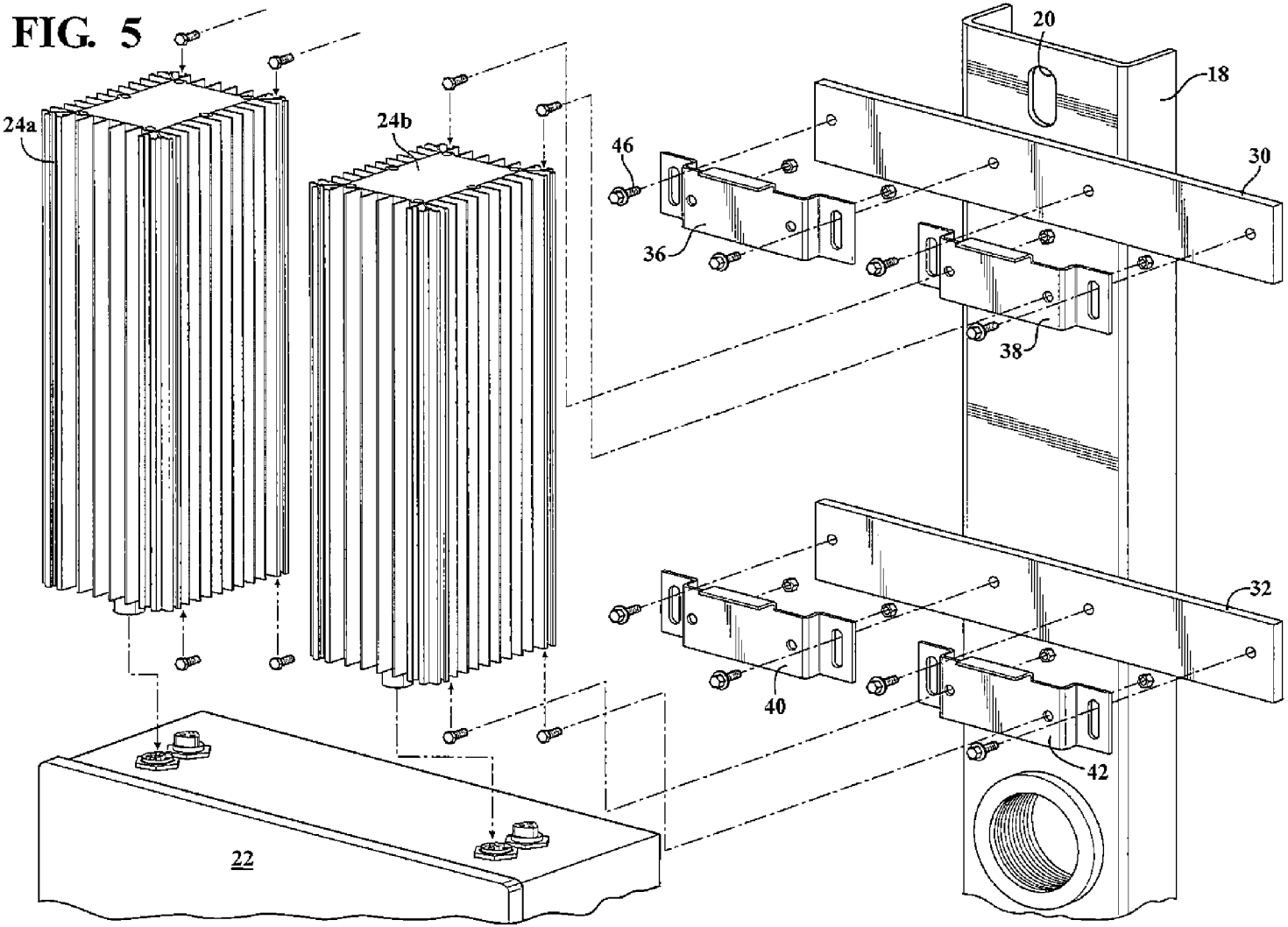
FIG. 5 is an exploded view, in perspective, of the two-ballast unit mounting assembly.

As described above, the weather tight enclosure box 22 is mounted substantially centrally on the front flat surface of the channel 18 directly over the round hole 26 which accommodates a nipple 28 extending through the back panel 29 of the enclosure 22 and into a threaded aperture 31 in the pole 10. Directly above and directly below the aperture 26 are additional structures to receive the four (or two) electronic ballast units 24*a*, 24*b*, 24*c*, 24*d*. The top structure for electronic ballast units 24*a*, 24*b* comprises a pair of horizontal ballast box mounting brackets 30, 32 which are bolted or riveted to the flat front surface of the channel 18 in parallel spaced-apart relationship. Fastened on top or on the front surface of the brackets 30, 32 are standoff brackets 36, 38, each having oblong holes 44 in the outboard portions thereof to allow the electronic ballast boxes 24*a*, 24*b*, respectively, to be attached by bolts and nuts 45. A similar pair of standoffs 40, 42 is mounted in spaced-apart relationship to the lower horizontal ballast box mounting bracket 32 and the ballast units 24*a*, 24*b* are bolted to these by fasteners 45. As shown in FIG. 3, electronic ballast unit 24*a* spans the standoffs 36, 40 and is secured thereto by means of the screws shown in FIG. 5 so as to be immediately adjacent the top panel of the weather tight enclosure 22. Similarly, electronic ballast unit 24*b* is secured to and spans across the standoffs 38, 42 so as to be immediately adjacent the right side of the top panel of the enclosure 22 as shown in FIG. 3.

Figure 6:
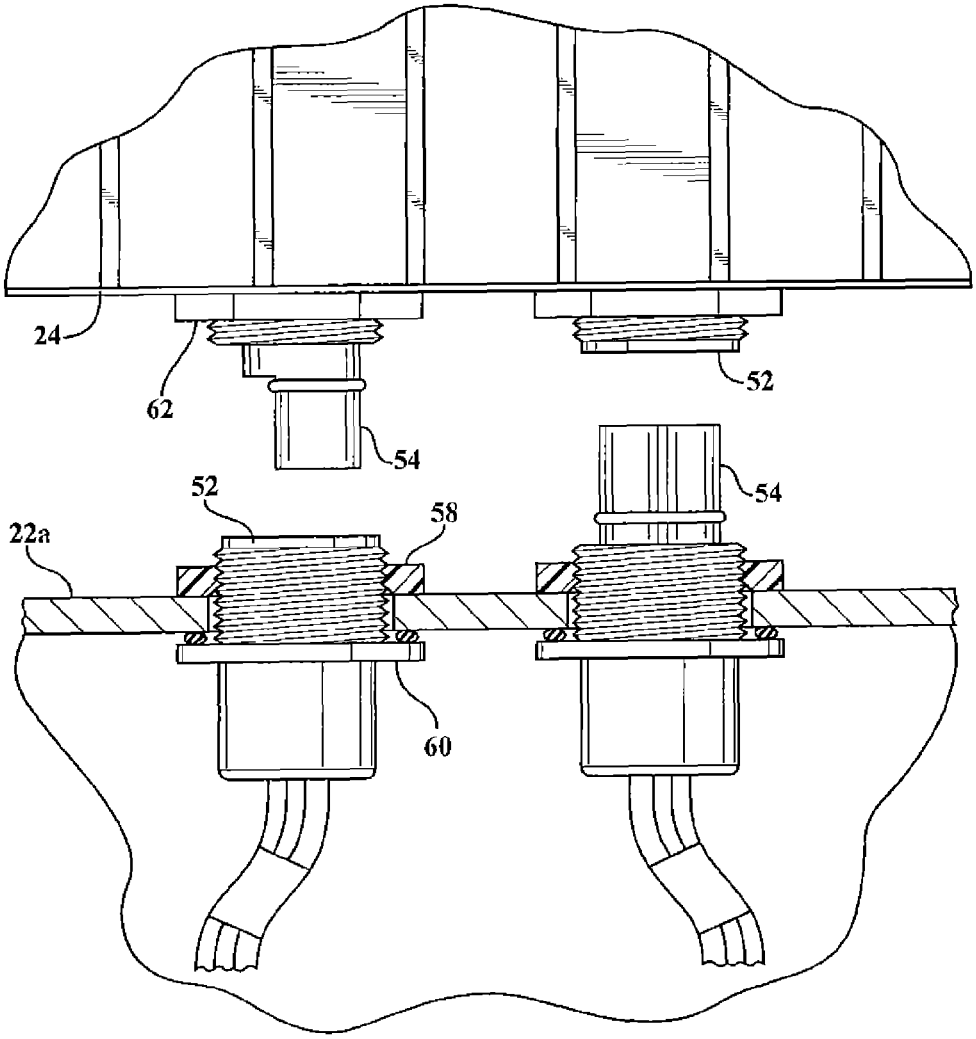
FIG. 6 is a detailed view of two ballast-to-enclosure connectors in the unplugged condition.

It is necessary to provide electrical connections from the components inside of the weather tight enclosure 22 both as inputs to and outputs from each of the ballast units 24*a*, 24*b*. For this purpose, two-part connectors 50 are used. Suitable connectors are available from Wieland and comprise a female part 52 and a complemental male plug part 54. There are two connectors 50 for each ballast unit 24 and the mountings of the connectors are reversely similar; i.e., one has the male part 54 on the ballast unit 24 and the other has it on the enclosure panel as shown in FIG. 6. Each enclosure-side part is mounted by means of threaded nuts 58, 60 to the top wall 22*a* of the weather tight enclosure 22. Each connector male part 54 is mounted by means of plastic nuts 62 opposite and in alignment with a female part 52. It will be apparent that there are two such connectors for each ballast unit 20, one running as an input to the ballast unit and the other running as an output from the ballast unit to the components on the interior of the enclosure 22.

The spacing and alignment of the connector components is important; i.e., they must be located so that when the ballast units are mounted on the standoffs, for example 36, 40, the male parts of the connectors 50 are in alignment with the female parts 52. In the mounting process, the bolts 46 holding the standoffs 36, 40 to the cross brackets 30, 32 are loosened so that the oblong holes 44 in the standoffs provide limited axial sliding movement of the electronic ballast units, in this case units 24*a* and 24*b*, relative to the enclosure 22. When the connectors 50 are fully lined up, the ballast units 24 are then caused to slide vertically downwardly so as to make a full electrical contact between the connector parts 52, 54, after which the fasteners including bolts 46 are tightened down.

A reversely similar arrangement of parts is found below the enclosure 22 to accommodate the electronic ballast units 24*c*, 24*d* in the four-ballast assembly shown in FIG. 3. A second set of horizontal brackets 62, 64 is attached to the front surface of the channel 18 below the weather tight enclosure 22. Standoffs 66, 68 are provided for electronic ballast unit 22 and a fourth set of standoffs 70, 72 is provided for the ballast unit 24*d*. As shown in FIG. 3, there are two-part complemental electrical Wieland connectors 50 fitted between the top surfaces of the electronic ballast units 24*c*, 24*d* and the bottom panel of the enclosure 22 in exactly the same fashion as is provided on the top panel of the enclosure 22 for the uppermost ballast units 24*a*, 24*b*. The lower units 24*c*, 24*d* are installed in the same fashion as is described above; i.e., the fasteners holding the standoffs 66, 68, 70, 72 to the brackets 62, 64 are loosened, the connector parts are aligned, the electronic ballast units are, in this case, slid upwardly until the connector portions mate and thereafter the fasteners holding the standoffs to the brackets 62, 64 are tightened down.

Figure 2:
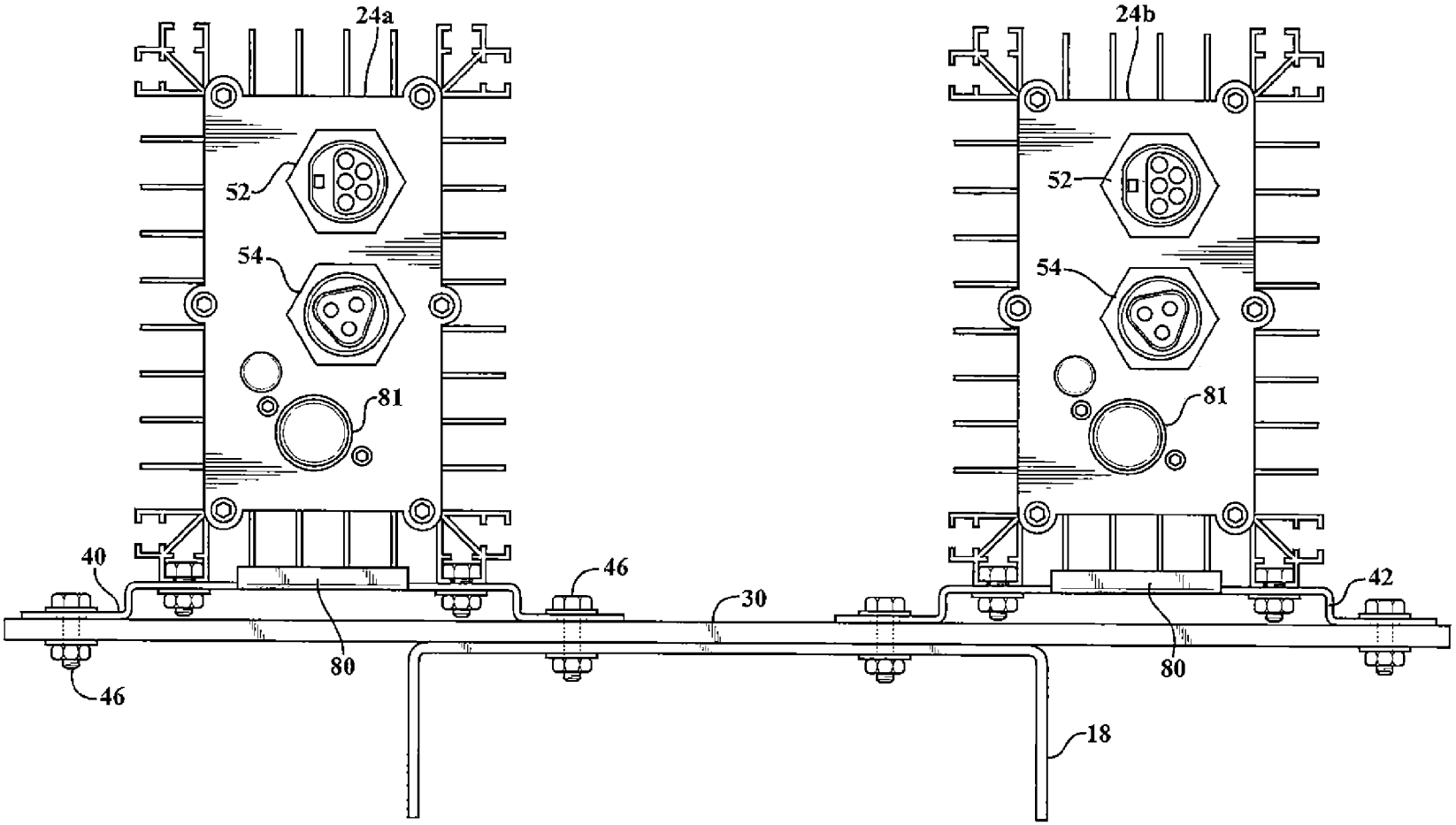
FIG. 2 is an end view of the ballast mounting assembly showing two ballast units.

It will be noted in the drawings that there is a third feature on the end plate of each of the electronic ballast units in addition to the two connector components. It will also be noted that whereas one of the connectors 50 has the male portion on the ballast unit and the female portion on the enclosure panel 22*a*, the other connector is mounted in the reverse fashion. In any event, the third feature is a radio frequency antenna 81 which allows the ballast unit carrying that antenna to be adjusted from a remote transmitter for purposes of turning lights on and off or reducing the power to the associated fixture for dimming or other light output adjustments. It will also be noted that the ballast units are heavily finned over all four of the major exterior surfaces. As shown in FIG. 2, two of the fin sets near the corners are constructed in such a way as to provide a channel capable of receiving the head of a screw or bolt 45 which extends through the standoff to secure the particular ballast unit to the standoff. It will also be noted in FIGS. 2 and 5 that each standoff is provided with a flange 80 which acts as a mechanical stop to hold the associated electronic ballast unit in place on the standoff. It is, in this particular arrangement, not necessary or desirable that movement of the ballast unit be permitted relative to the standoff because the particular fastening arrangement allows the standoff to slide relative to the underlying horizontal bracket 30 for purposes of making and breaking the electrical connections through the Wieland connectors 50. While we have found this arrangement to be workable and convenient, other arrangements to permit sliding the mounts are possible.

Figure 7:
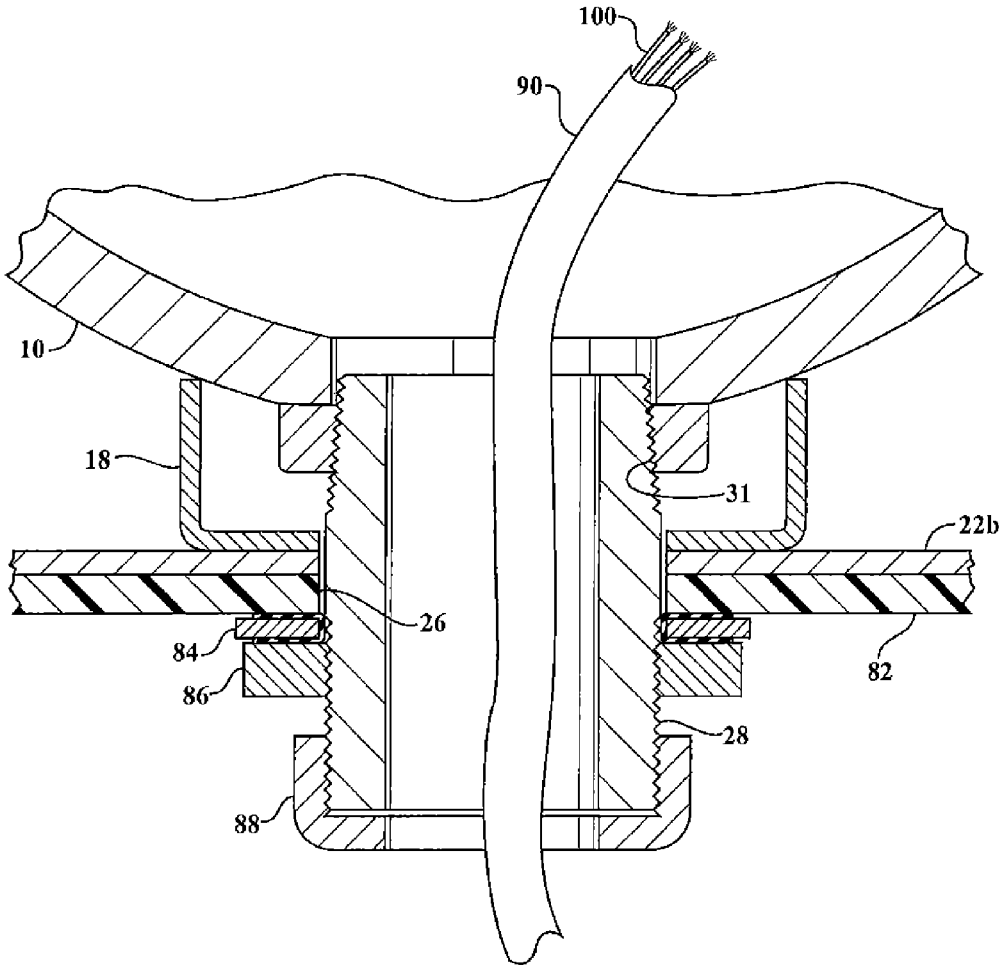
FIG. 7 is a sectional view of a nipple for conveying a cable from the interior of the enclosure into the pole.

Looking now to FIG. 3 which shows the enclosure 22 with the door open, there are fuse blocks and connector blocks mounted on a plate 82 within the enclosure. Although not shown in FIG. 3, there are various polyethylene sheathed wires extending from the inside ends of the connectors 50 to the fuse and connector blocks. FIG. 7 illustrates the nipple 28, a cylindrical steel pipe of about 4 to 6 inches in length, threaded at both ends to run from the interior of the enclosure 22 to the inside of the hollow pole 10. As described above, one end of the nipple is threaded into the pole or a fitting welded to the pole and the other end is held in place against the plate 82 by the combination of a gasketed steel ring 84 and a threaded lock ring 86. A plastic anti-chafing ring 88 is threaded to the top of the nipple 28. The nipple, thus, extends through the plate 82 within the enclosure, through the back plate 22*b* of the enclosure 22, through the channel 18 into the pole 10.

Figure 8:
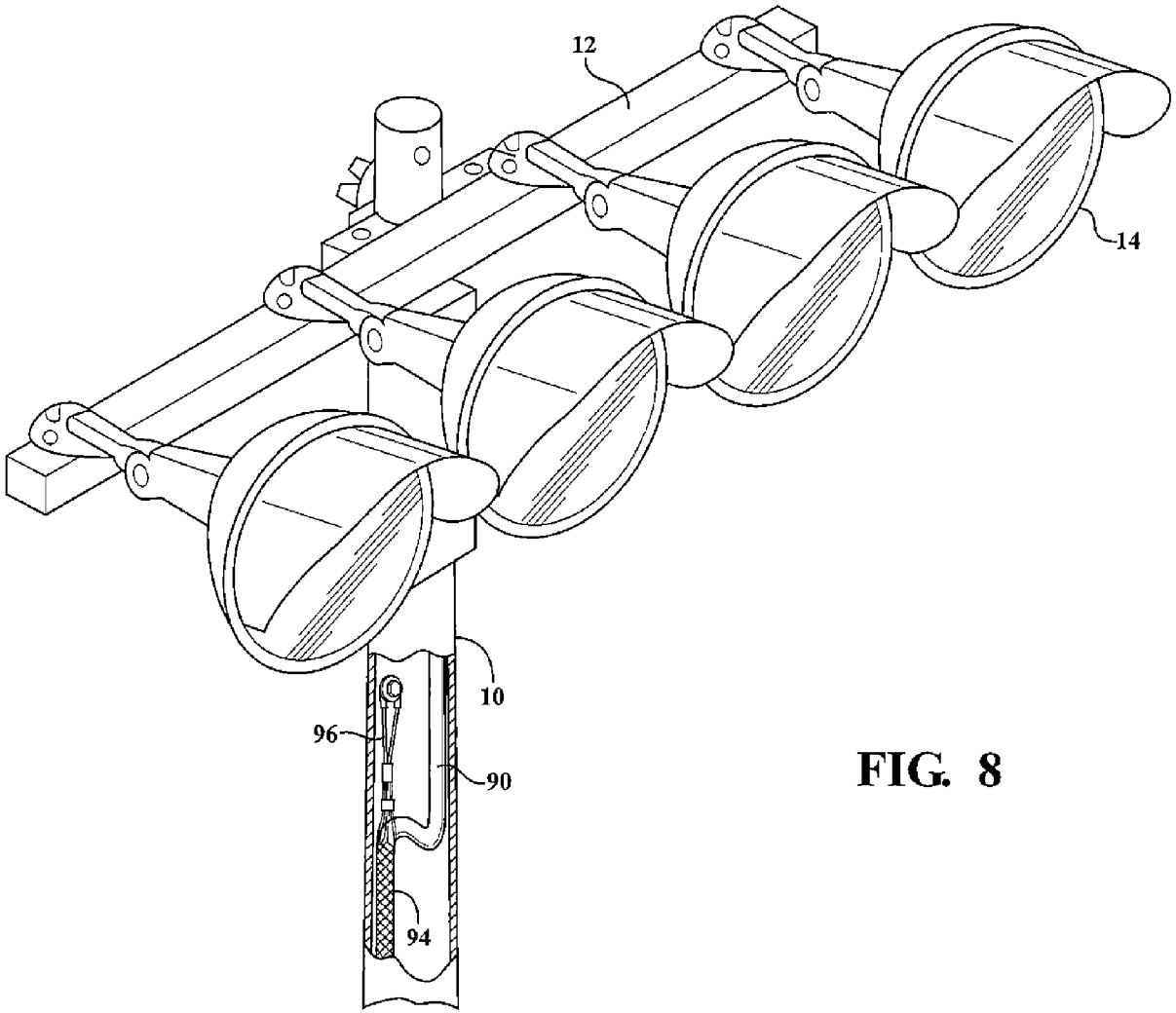
FIG. 8 is a perspective view of the four-fixture arrangement with the pole cut away to show a hanger for the power cable.

Referring to FIGS. 7 and 8, there is shown a section of the cable 90 which is used to make the connection between the components on the interior of the weather tight enclosure and the fixtures 14 on the cross arm 12. This cable may be up to 120 feet in length and be composed of as many as 13 polyethylene sheathed twisted strand wires 100 which in this embodiment are made up of 266 strands each of nickel-plated copper in a color-coded polyethylene insulation wrapping. The necessary number of these wires, along with plastic or fiberglass filler strands, are then sheathed in PVC. A Kelem grip 94 with a wire hanger 96 is attached to the PVC sheath so that the cable near the top end can be hung on a stud on the interior of the hollow pole 10 to take the weight of the cable off of the electrical connections between the cable and the individual fixtures. In a four-fixture arrangement, there will be nine 266-strand wires, two for each fixture plus a ground.

Referring to FIG. 4, there is shown a second embodiment of the invention using only two electronic ballast units 102, 104 to accommodate a lighting installation with only two luminaires. In this case, the electronic ballast units are mounted directly above or immediately above a weather tight enclosure 106 and have the same type of sliding standoff/bracket mounting hardware as is described above for the four-ballast assembly. The individual electronic ballast 102, 104 are of the same make and type as described above. The connectors may also be Wieland connectors and are made and broken in the same way. A nipple runs through the back of the enclosure 106 into and through the pole in the same way as is described above with respect to the four-ballast assembly. The channel member 18' is only three feet long since the additional length for additional ballast units is not needed.

It is to be understood that the various changes and modifications of the invention can be made while achieving the end objectives which are described above. For example, it may be possible to eliminate the horizontal cross brackets in favor of a wider support. However, a narrower support is preferable for pole-mounted installations to reduce windage effects and to conserve weight. The sliding feature can be achieved in other ways; for example, the elongate holes may be provided in the channel rather than in the standoffs, practical considerations coming to bear on the end result of this arrangement. For a definition of the invention and the exclusionary power represented by the patent grant, reference should be taken to the appended claims.

What is claimed is:

1. Apparatus for providing power to pole-mounted HID lighting fixtures comprising:

a support comprising a vertical member and two vertically spaced parallel cross-arms fixed thereto, said support adapted to be mounted on a pole at a position remote from said fixtures;

a weather tight enclosure fixedly mounted on said support for housing electrical components;

a first electrical plug connector mounted on the exterior of the enclosure;

an electronic ballast unit; a pair of standoff brackets fixedly secured to the ballast unit with a vertical spacing between said brackets equal to the vertical spacing between said cross-arms such that the ballast unit may be mounted to the cross-arms by way of said standoff brackets, said standoff brackets having elongate screw holes formed in laterally opposite portions thereof; the horizontal distance between the elongate screw holes being greater than the width of the ballast unit whereby the ballast unit may be secured to said cross-arms by access to screws in said screw holes; said elongate slots providing limited sliding movement of said ballast unit relative to said support and said cross-arms during installation; and a second electrical plug connector mounted on said ballast unit and being complemental and joinable to the first electrical plug connector; said plug connectors being aligned when the ballast unit is mounted on the support by way of the cross-arms and standoff brackets, such that the limited sliding motion of said ballast unit relative to said support joins said plug connectors to make an electrical connection.

2. Apparatus as defined in claim 1 wherein said support comprises an elongate channel member.

3. Apparatus as defined in claim 1 wherein said weather tight enclosure comprises a metal box having at least one relatively flat exterior panel.

4. Apparatus as defined in claim 1 further comprising a radio receiving antenna connected to said ballast unit for activating and deactivating the ballast unit on demand.

5. Apparatus as defined in claim 1 further comprising a hollow pole, said support being mounted to said pole; said apparatus further comprising a nipple connected between the enclosure and the interior of said pole; and a high strand count copper wire cable extending from components within said enclosure to and through the interior of said hollow pole.

6. Apparatus as defined in claim 5 further comprising means for hanging said cable to a pole at a location which is substantially vertically above the location of said enclosure.

7. Apparatus for mounting ballast boxes for HID lighting fixtures on a pole comprising:

a support structure comprising a rigid vertical component and at least two vertically spaced cross-arms fixedly secured thereto;

a pair of ballast boxes mounted in side-by-side relationship to and extending between said vertically spaced cross-arms, each ballast unit having secured thereto a pair of vertically spaced standoff brackets that are wider than the ballast units and have elongate screw holes in horizontally opposite end portions thereof, the vertical spacing between said standoff brackets for each said ballast unit being substantially equal to the spacing between the horizontal cross-arms, the elongate screw holes in said standoff brackets permitting limited sliding movement between the ballast units and the support during installation thereof; and each of said ballast units having a plug-type electrical connector installed in an end thereof.

8. Apparatus as defined in claim 7 further comprising an enclosure fixedly mounted on said support immediately below the ballast units, said enclosure having a set of plug-type electrical connectors installed in a surface thereof in alignment with the plug-type connectors in the ballast units whereby said limited sliding movement of said ballast units can be used to establish electrical connections between electric plug connectors on the ballast units and on the enclosure.

9. Apparatus as defined in claim 7 wherein each of said ballast units has a radio receiver antenna mounted thereto for activating or deactivating each individual ballast unit.

10. Apparatus as defined in claim 8 further comprising a hollow pole and a set of HID lighting fixtures carried by said pole vertically above said support and said ballast units, an electrical cable connected from the enclosure to the HID lighting fixtures.

11. Apparatus as defined in claim 10 further comprising a hanger attached to said cable for mechanically connecting said cable to said interior of said pole at a position substantially vertically above said support.

* * * * *